US011524208B2

(12) United States Patent
Kang

(10) Patent No.: US 11,524,208 B2
(45) Date of Patent: Dec. 13, 2022

(54) INDOOR CYCLE MACHINE PROVIDING USER WITH VIRTUAL EXPERIENCE AND EXERCISE WITHOUT STRAINING KNEE

(71) Applicants: VRCARVER INC., Seoul (KR); Too Hwan Kang, Seoul (KR)

(72) Inventor: Too Hwan Kang, Seoul (KR)

(73) Assignees: VRCARVER INC., Seoul (KR); Too Hwan Kang, Seoul (KR)

( * ) Notice: Subject to any disclaimer, the term of this patent is extended or adjusted under 35 U.S.C. 154(b) by 155 days.

(21) Appl. No.: 17/064,510

(22) Filed: Oct. 6, 2020

(65) Prior Publication Data

US 2022/0047916 A1 Feb. 17, 2022

(30) Foreign Application Priority Data

Aug. 13, 2020 (KR) ..... 10-2020-0102098

(51) Int. Cl.
*A63B 22/06* (2006.01)
*A63B 24/00* (2006.01)
*A63B 71/06* (2006.01)

(52) U.S. Cl.
CPC ..... *A63B 22/0605* (2013.01); *A63B 24/0087* (2013.01); *A63B 71/0622* (2013.01); *A63B 2022/0641* (2013.01); *A63B 2071/0625* (2013.01); *A63B 2071/0644* (2013.01)

(58) Field of Classification Search
None
See application file for complete search history.

(56) References Cited

U.S. PATENT DOCUMENTS 4,711,447 A * 12/1987 Mansfield ..... A63B 22/0605 482/7
5,549,527 A * 8/1996 Yu ..... A63B 21/00196 482/57
6,244,989 B1 * 6/2001 Chen ..... A63B 22/0056 482/57
7,278,956 B1 * 10/2007 Chen ..... A63B 22/0605 482/57
7,582,044 B2 * 9/2009 M gica Miguel ..... A63B 69/16 482/61

(Continued)

FOREIGN PATENT DOCUMENTS

CN 109107092 A * 1/2019 ..... A63B 22/0605
JP H02136674 U * 11/1990

(Continued)

*Primary Examiner* — Sundhara M Ganesan
*Assistant Examiner* — Shila Jalalzadeh Abyaneh
(74) *Attorney, Agent, or Firm* — Maschoff Brennan

(57) ABSTRACT

Disclosed is an indoor cycle machine providing a user with virtual experience and exercise without straining knees, the indoor cycle machine comprising: a main body rotatably coupled onto a floor portion; a vertical support having one end coupled to the floor portion and an opposite end formed with a vertical through-hole; and a saddle support having one end coupled to an upper end of the main body and an opposite end formed with a saddle, in which the saddle support passes through the vertical through-hole such that the saddle support is rotatable inside the vertical through-hole, wherein the main body is rotated on the floor portion whenever the user steps on a pedal formed on the main body.

11 Claims, 10 Drawing Sheets

(56) References Cited

U.S. PATENT DOCUMENTS

| | | | | |
|---|---|---|---|---|
| 7,922,627 | B2 * | 4/2011 | Clark | A63B 22/0087 482/57 |
| 9,061,174 | B2 * | 6/2015 | Jun | A63B 21/00196 |
| 2005/0101449 | A1 * | 5/2005 | Fan | A63B 22/14 482/57 |
| 2006/0058163 | A1 * | 3/2006 | Matsumoto | A63B 22/0605 482/57 |
| 2007/0238584 | A1 * | 10/2007 | Lee | A63B 22/0605 482/57 |
| 2007/0281834 | A1 * | 12/2007 | Lai | A63B 22/0605 482/57 |
| 2013/0130798 | A1 * | 5/2013 | Nir | A63F 13/803 463/36 |
| 2017/0072254 | A1 * | 3/2017 | Ryu | A63G 31/16 |
| 2021/0275862 | A1 * | 9/2021 | Kim | A63B 22/0605 |

FOREIGN PATENT DOCUMENTS

| | | | | |
|---|---|---|---|---|
| KR | 2009031714 | A * | 3/2009 | A63B 22/14 |
| KR | 10-1743975 | | 6/2017 | |
| KR | 20180083078 | A * | 7/2018 | A63B 21/4034 |
| WO | WO-2010085010 | A1 * | 7/2010 | A61H 1/0214 |
| WO | WO-2010104316 | A2 * | 9/2010 | A63B 22/14 |

* cited by examiner

INDOOR CYCLE MACHINE PROVIDING USER WITH VIRTUAL EXPERIENCE AND EXERCISE WITHOUT STRAINING KNEE

BACKGROUND OF THE INVENTION

1. Field of the Invention

The present invention relates to an indoor cycle machine providing a user with virtual experience and exercise without straining knees.

2. Description of the Prior Art

The present invention relates to an indoor cycle machine providing a user with virtual experience and exercise without straining knees. The cycle machine refers to a device allowing a user to exercise a lower body including legs in such a way that the user makes a rotary motion by stepping on and turning a pedal instead of directly riding a cycle at home or outdoors.

These days, there are still many places where bicycle paths are not properly installed, thereby making it impossible to go cycling or directly ride a bicycle on the road. Furthermore, there is also a risk of collision with vehicles or pedestrians when riding a bicycle in a place other than the bicycle path. Recently, it is also difficult to do exercise outside for a long time due to frequent yellow dust or fine dust, and thus indoor cycle machines are widely supplied and used to exercise indoors, and similar types of cycle machines are often installed in parks and the like so that many people can use the cycle machines.

The cycle machines are widely used because they can involve a large quantity of exercise even in a narrow space. The conventional cycle machine can enable a user to exercise only a lower body by simply stepping on a pedal. Thus, if it is possible to exercise not only the lower body, but also other parts of the body, the user will be able to do exercise indoors without a need for other exercise equipment, thereby making it possible to involve a greater amount of exercise in a narrow space. In addition, the user can do various exercises even with one cycle machine.

However, the conventional cycle machine enables the user to do an exercise of stepping on a pedal while sitting, but this is not a natural exercise. When the user steps on the pedal in one direction, the natural exercise may be performed in such a way that the large joints or knee joints do not move in a straight line, but slightly turn in a direction that the user steps on the pedal while the bent legs are stretched, and then the legs are restored to an original position and are stretched again in a straight line. In other words, in the conventional indoor cycle, a handlebar and the pedal are not turned right and left, but are fixed. Thus, when the user steps on the pedal, the legs of the user may move in a straight line only. If the user repeatedly performs exercise for a long time by using the indoor cycle, the subtle unnatural movements as above may be repeated, thereby causing the strain to the large joints or knee joints.

Nevertheless, for maintaining healthy joints, it is not preferable not to move the joints at all. In order to properly exercise the joints, it is preferable to do exercise with the help of a rehabilitation therapist in a hospital. In reality, however, it is difficult to receive the help due to economic conditions or geographical problems of requiring direct visits, unless a situation is serious. Furthermore, there is a method for exercising underwater, in which the user does exercise without burdening the body in a swimming pool.

However, this method also has a problem in terms of time and costs and thus cannot be easily put into practice in reality unless specialized treatment is required due to a serious situation. In particular, in such case, it is often not easy to go outside and do exercise. In addition, these days, in many cases, people are reluctant to do exercise outside due to yellow dust or fine dust.

Thus, there is a need for exercise equipment, which is so simple and convenient that the user can easily do exercise at home, and which is also effective enough for the user to make a natural movement without straining knees. The exercise equipment needs to be inexpensive, not to take much space for installation, and not to cause complaints about noise and the like to neighbors while the equipment is in use. If possible, the exercise equipment needs not to let the user feel bored even after taking repeated exercise for long hours.

Korean Patent Registration No. 10-1743975 discloses a cycle machine for indoor exercise with a horseback riding function, wherein the machine comprises a driving unit for generating a rotational force, in which one side of the machine is connected to the driving unit through a power transmission unit, and the power transferred through the driving unit is transferred to an oscillating saddle portion, so that a horizontal rotating shaft is rotated to cause an eccentric motion, thereby fluctuating the saddle portion in either up and down or front and back direction with the addition of the horseback riding function. However, there is still a disadvantage in that the horseback riding function is not connected to pedaling, and thus the pedaling for stretching knees is the same as the conventional simple pedaling, thereby straining the knees.

In addition, equipment such as the cycle machine needs to secure a certain amount of space for safety in actual use, so that the equipment can provide the user with a stable exercise without falling down. However, as a floor area occupied by the equipment increases, it becomes more difficult to store the equipment when it is not in use. Thus, for indoor use, there is a need for equipment requiring a less space when it is stored.

SUMMARY OF THE INVENTION

To achieve the above objects, the present invention provides a cycle machine providing a user with various exercises while saving a space during storage.

In addition, another object of the present invention is to provide an exercise device that enables a pedaling exercise to make a more natural movement. There are many methods for stretching knees when pedaling. In the present invention, a bearing is mounted on a lower part of a pedal with respect to a rotational central shaft in order to make a rotation right and left. Thus, if a user steps on the pedal in one direction, bent legs are stretched and slightly turned in a direction that the user steps on, and then the legs are stretched in an original position, thereby attenuating the strain applied to the knees. In other words, when pedaling, the rotation may be made right and left without straining large joints or knee joints as much as possible. Another object of the present invention is to optimize health maintenance or rehabilitation by preventing accumulation of minute unnatural movements even when exercising for a long time or doing the exercise repeatedly.

In addition, the present invention provides a system for allowing the user to do an exercise similar to reality while playing a game using a virtual reality device indoors rather than actually riding a bicycle. Particularly, another object of the present invention is to provide the user with virtual experience such as participating in a remote racing field on a real time basis by providing a display image based on the input of the downloaded or streamed live-action content provided by a remote provider through a content server, by controlling a mechanical component and a user avatar in image based on a user input, and by outputting an interaction message according to the results of comparing an image footprint and a user avatar footprint during the progress of virtual experience.

To achieve the above objects, there may be provided an indoor cycle machine providing a user with virtual experience and exercise without straining knees, the indoor cycle machine including: a main body (11) rotatably coupled onto a floor portion (14); a vertical support (12) having one end coupled to the floor portion (14) and an opposite end formed with a vertical through-hole (13); and a saddle support (15) having one end coupled to an upper end of the main body (11) and an opposite end formed with a saddle (16), in which the saddle support (15) passes through the vertical through-hole (13) such that the saddle support (15) is rotatable inside the vertical through-hole (13), wherein the main body (11) is rotated on the floor portion (14) whenever the user steps on a pedal formed on the main body (11).

A central shaft (22) may extend in a vertical direction of the main body (11), and the saddle support (15) may be coupled upward of the central shaft (22), so that the main body (11) may move and rotate according to rotation of the central shaft (22).

The main body (11) may include a repositioning device formed of an elastic material, so that the main body (11) may rotate in one direction and return back to an original position.

Wheels (25) may be formed at both sides of the floor portion (14), the wheel (25) may move by rolling in an inner part of a rail portion (31) of a first floor arm (17) and a second floor arm (18) having a section of "ㄷ" shape, and a rail support portion (32) may be formed at an outer side of the rail portion (31) to support the rail portion (31).

The rail support portion (32) of each of the first floor arm (17) and the second floor arm (18) may be rotatably coupled to a second rotating shaft (26).

A rotary plate (23) having a round plate shape may be attached to a lower end of the central shaft (22), the central shaft (22) may rotate along a bearing (24) attached to the floor portion (14), and a plurality of rotation support balls (27) may be formed under the rotary plate (23) and on a bottom surface of the floor portion (14) to support the rotary plate (23) while allowing the rotary plate (23) to smoothly rotate.

A control unit may be formed at the main body (11) for settings required for exercise.

A pin hole for pin coupling may be formed at an upper surface of the rail support portion (32), so that a pin (28) may be inserted and coupled into both a pin hole formed in the floor portion (14) and a pin hole formed in an upper surface of the rail support portion (32) when an upper surface of the floor portion (14) covers an upper surface of the rail support portion (32).

The first floor arm (17) may be coupled to both sides of the floor portion (14) and the second floor arm (18) may be received into a space inside the first floor arm (17), so as to reduce a space occupied by the floor surface when folded.

In addition, there may be provided the indoor cycle machine providing a user with virtual experience and various exercises while saving a space during storage, which further a mechanical component for controlling a motion of the cycle machine, and an attraction controller for controlling the mechanical component by receiving an input from a riding device and outputting a video and an audio.

According to the present invention as described above, there can be provided an indoor cycle machine providing a user with various exercises while requiring a small space for use and imposing less strain on the knees.

DETAILED DESCRIPTION OF THE EXEMPLARY EMBODIMENTS

Figure 1:
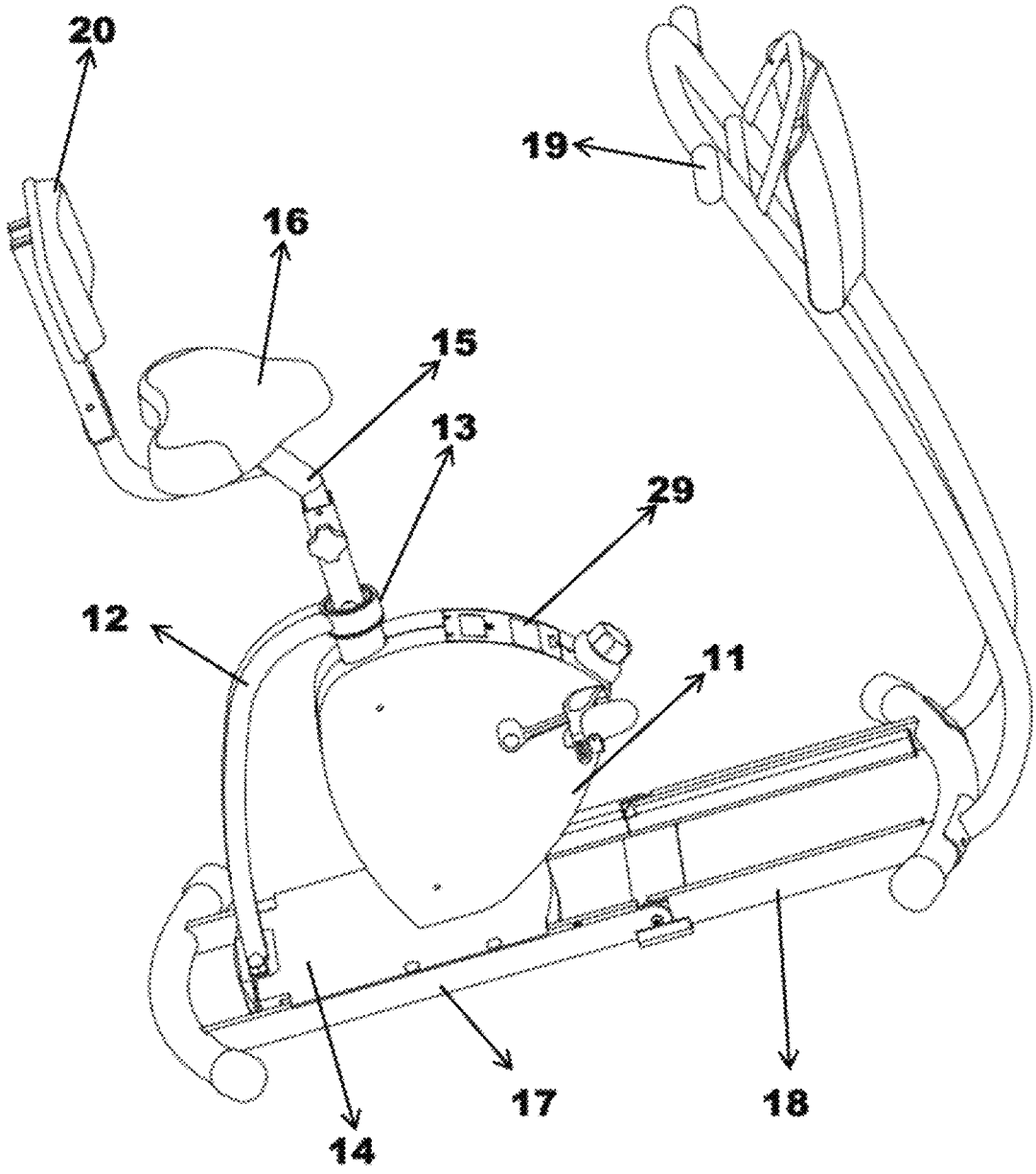
FIGS. 1 to 12 are views showing one embodiment according to the present invention.
Figure 2:
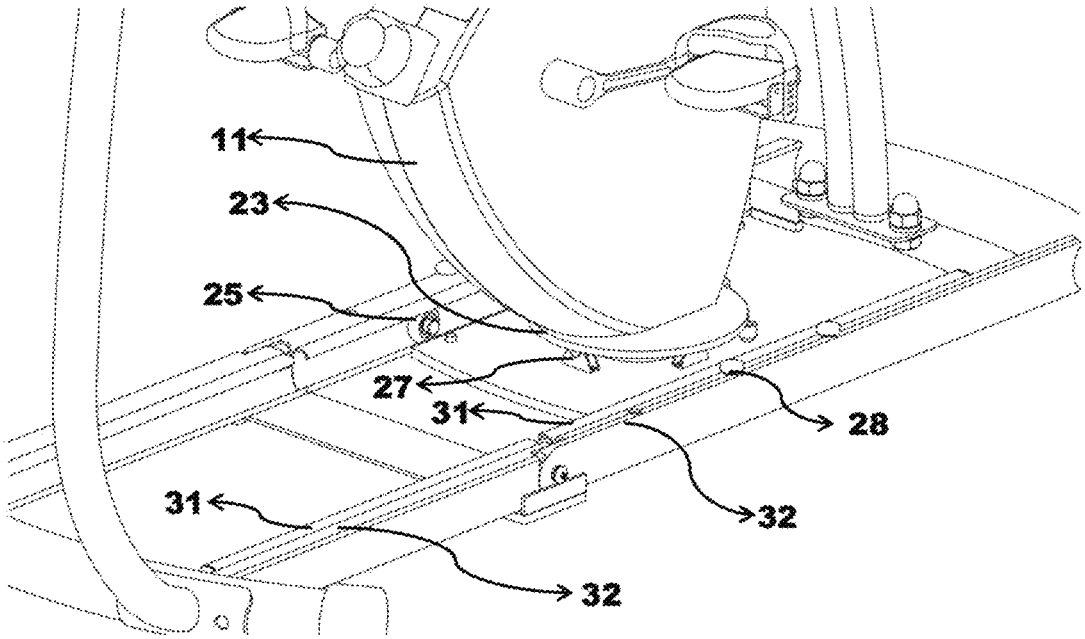
Figure 3:
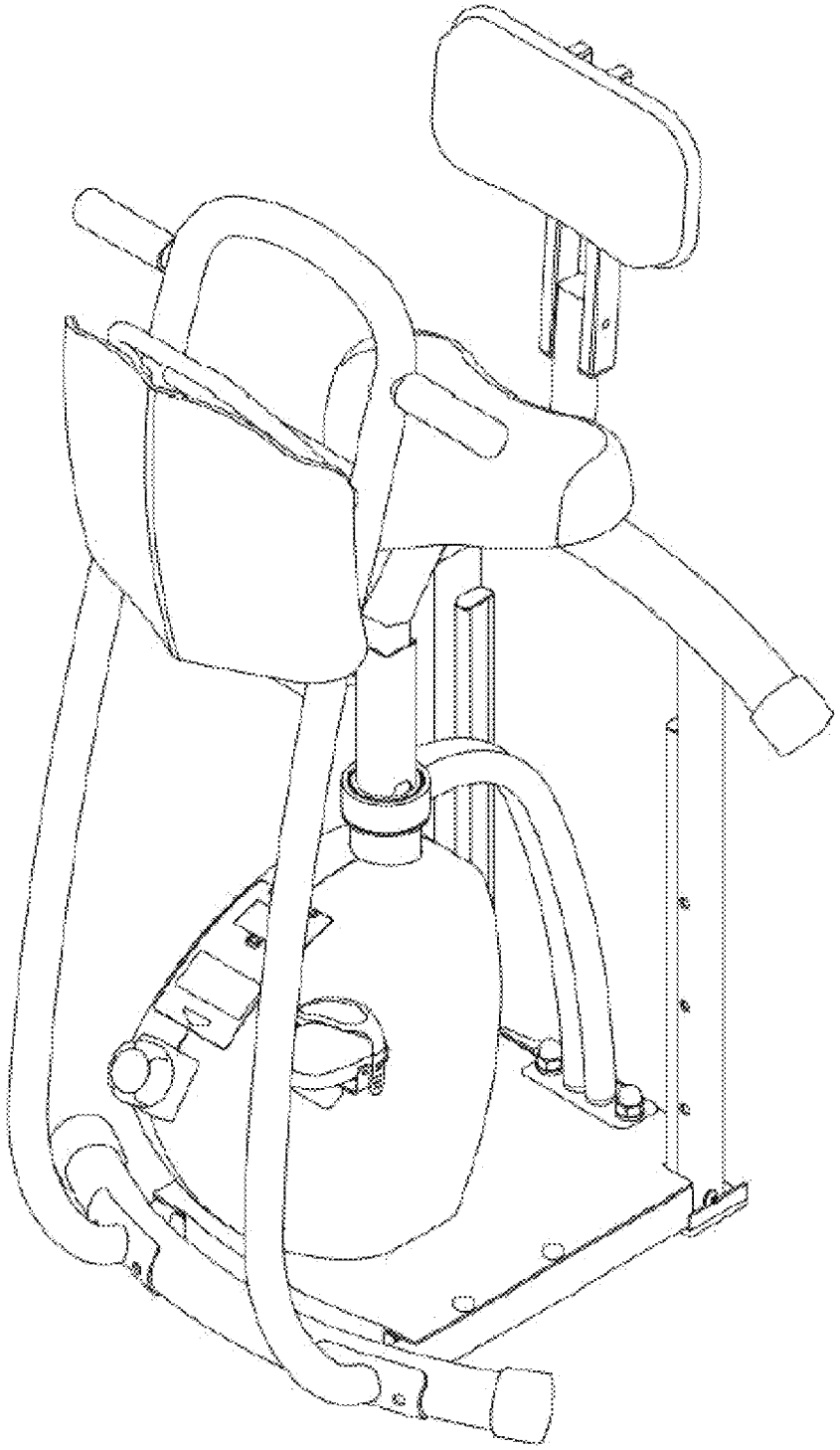
Figure 4:
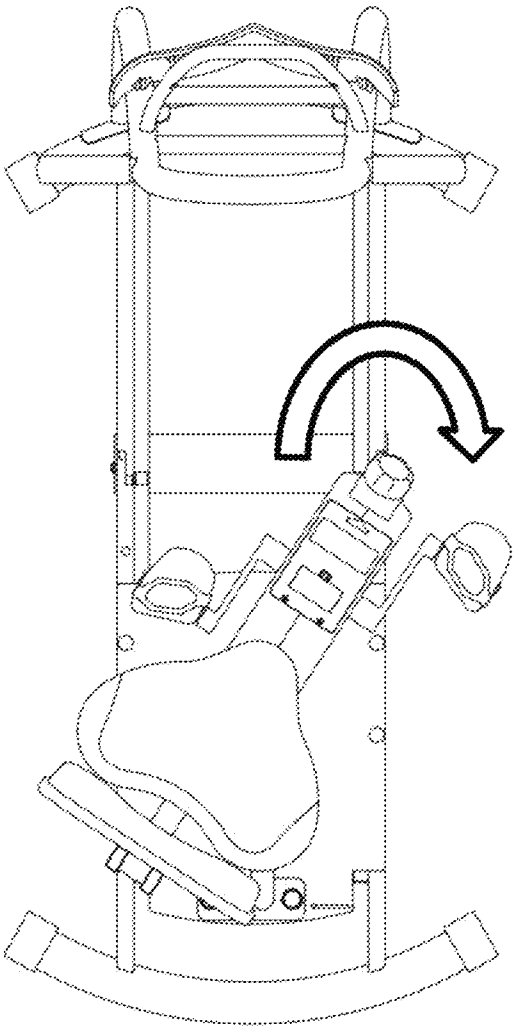
Figure 5:
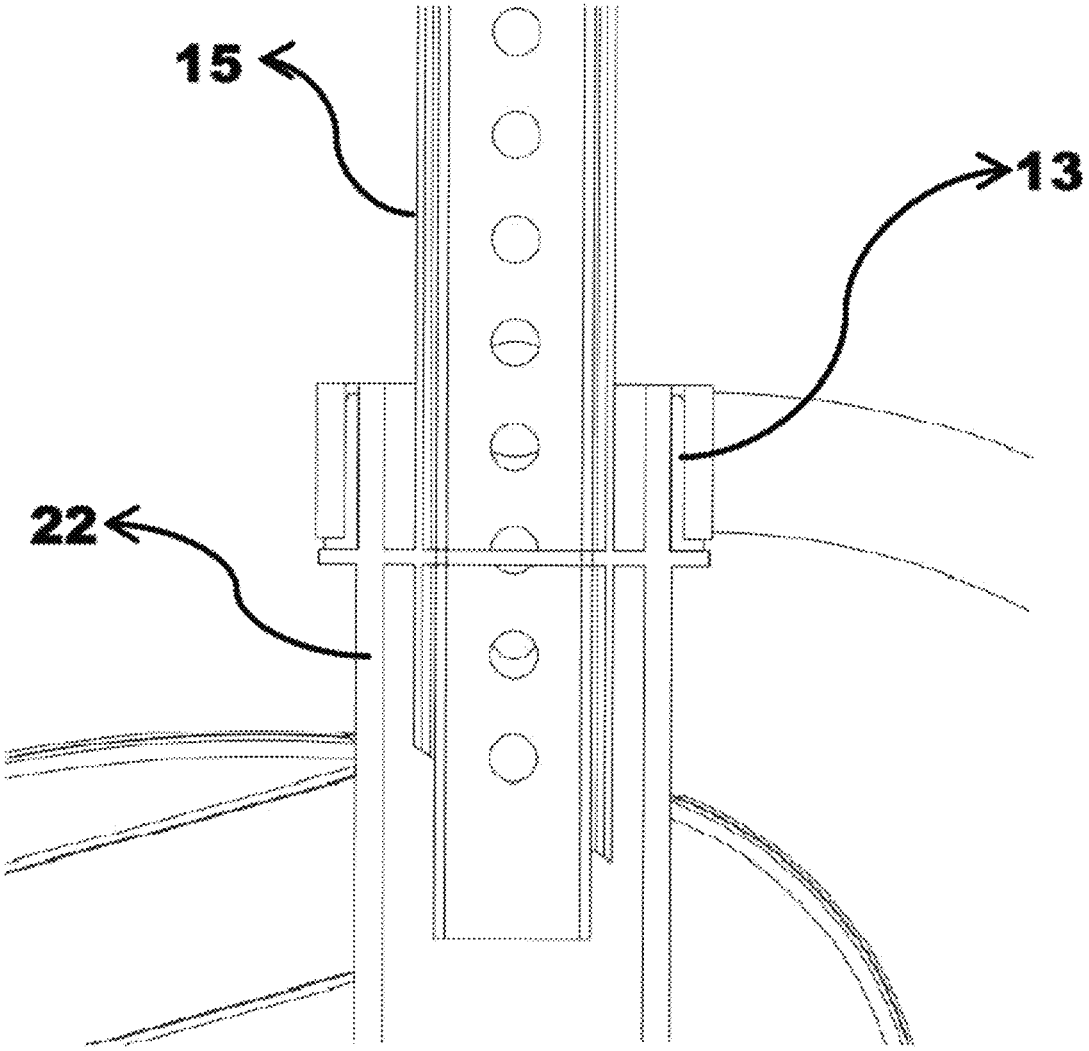
Figure 6:
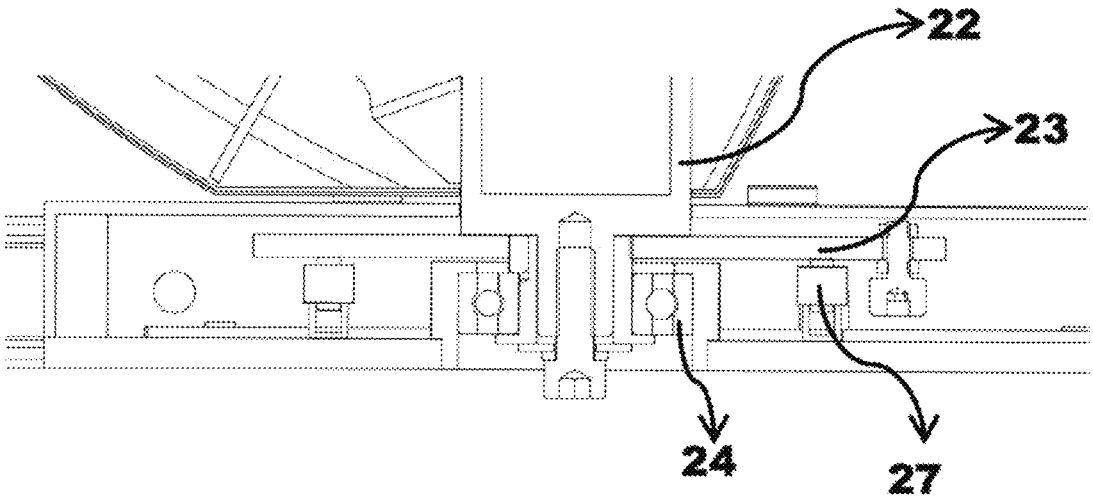
Figure 7:
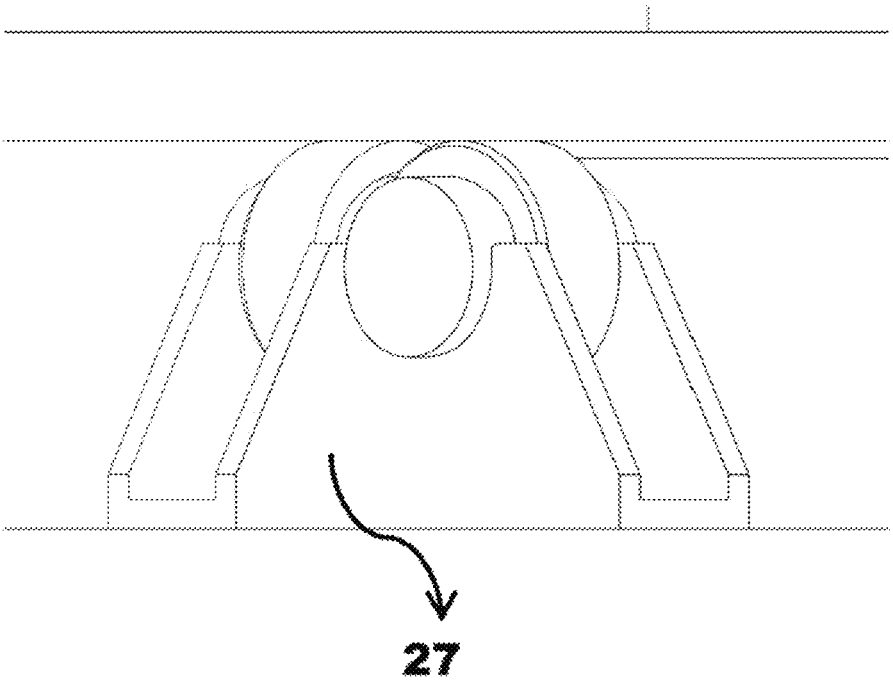
Figure 8:
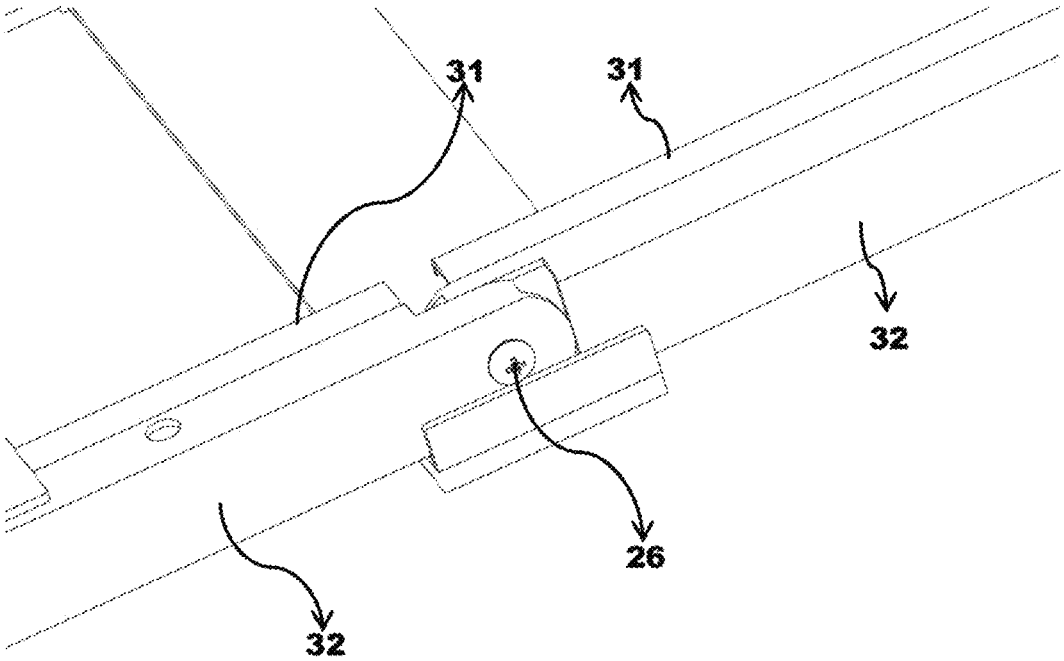
Figure 9:
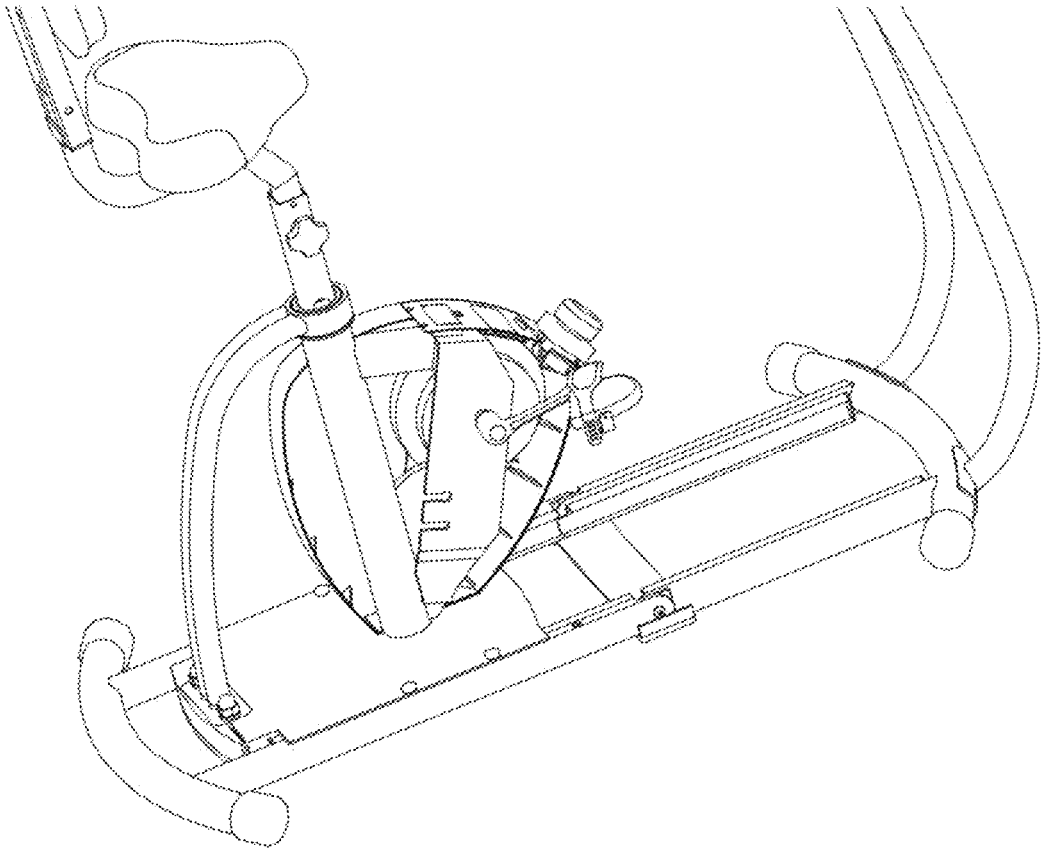

The present invention may be applied with various modifications and have various embodiments, but specific embodiments will be illustrated in the drawings and described in detail in the detailed description. However, this is not intended to limit the present invention to specific embodiment forms, and should be understood to include all modifications, equivalents, and substitutes included in the spirit and scope of the present invention. Similar reference numerals have been used to designate similar components throughout the drawings.

Terms such as first, second, A, B, etc. may be used to describe various components, but the components are not limited by the above terms. The terms may be used only for distinguishing one component from other components. For example, a first component may be referred to as a second component without departing from the scope of the present invention, and similarly, the second component may be referred to as the first component. The term "and/or" includes a combination of a plurality of related described items or any one of a plurality of related described items.

When one element is described as being "connected" or "accessed" to another element, it shall be construed as being connected or accessed to the other element directly but also as possibly having another element in between. On the other hand, if one element is described as being "directly connected" or "directly accessed" to another element, it shall be construed that there is no other element in between.

The terms used in the description are intended to describe certain embodiments only, and shall by no means restrict the present invention. The terms of a singular form may include plural forms unless otherwise specified. Further, the terms "including" and "having" are used to designate that the features, the numbers, the steps, the elements, the components, or combinations thereof described in the specification are present, and are not to be understood as excluding the possibility that one or more other features, numbers, steps, elements, components, or combinations thereof may be present or added.

Unless otherwise defined, all terms, including technical terms and scientific terms, used herein have the same meaning as how they are generally understood by those of ordinary skill in the art to which the invention pertains. Any term that is defined in a general dictionary shall be construed to have the same meaning in the context of the relevant art, and, unless otherwise defined explicitly, shall not be interpreted to have an idealistic or excessively formalistic meaning.

Hereinafter, the present invention will be described in detail with reference to the accompanying drawings. In general, attraction is a term that designates a playground equipment installed in an amusement park, etc., and in particular, is a term that refers to an apparatus for providing pleasure to a user by providing various combinations of rotational motion, tilt motion, uniform motion, accelerated movement, etc., while the user is on board. In recent years, there has been a progress of virtual reality attraction that enables the user to experience immersive virtual reality by driving a riding portion of the user in a mechanical manner, while providing the user with images according to a predetermined scenario through a display device. Furthermore, technology related to the above virtual reality attraction has expanded to various fields such as amusement equipment as well as simulators, exercise equipment, virtual experience equipment, etc., with the recent development of head-mounted display images. In particular, since users may be provided with experience similar to reality, there has been a growing consumer expectation for the field of virtual experience using attraction. In general, in the virtual experience device using attraction, it is common to program machine-driving data for operating a machine part of attraction in response to the user's manipulation separately from virtual experience background data for displaying on a display portion. Out of the above data, the virtual experience background data have been usually generated based on computer graphics, although the virtual experience background data partially include actual images.

To use the above attraction indoors, however, a cycle machine is required, but the cycle machine occupies much space, if the equipment is to be installed at home. If the equipment is used only for virtual experience, there is a problem of taking up too much space and requiring too high purchase price or maintenance costs compared to usage efficiency. To overcome the above drawbacks, the present invention may provide a system for allowing a user to do exercise without straining knees while reducing a space occupied.

Drawings show one embodiment according to the present invention. In the drawings, a main body 11 may be coupled onto a floor portion 14, and a first floor arm 17 may be attached to both sides of the floor portion 14.

The main body 11 may be rotatably coupled onto the floor portion 14, a central shaft 22 formed inside the main body 11 may have one end rotatably coupled to the floor portion 14, a saddle support 15 may be coupled to an end of the central shaft 22, the main body 11 may be formed to surround the central shaft 22, and the main body 11 and the central shaft 22 may rotate together.

A saddle support 15 may have one end coupled to the central shaft 22 inside the main body 11 and an opposite end extending by passing through a vertical through-hole 13 of the vertical support 12 such that the saddle support 15 may be rotatable within the vertical through-hole 13. In other words, the main body 11 and the saddle support 15 may rotate together. When the saddle support 15 rotates, a saddle 16 may also rotate together. The vertical support 12 may have one end coupled to the floor portion and may be formed in a curved shape, so that the vertical support 12 may extend over the main body 11 from a rear lower portion of the main body 11.

The saddle 16 may be coupled to an end of the saddle support 15, and a height of the saddle 16 may be changed depending on a user's height, and a backrest 20 branching from a lower side of the saddle 16 may be also formed to prevent the user from falling backward when the user sits on the saddle 16.

The main body 11 may have the central shaft 22 rotated together in a direction that the user steps on a pedal 21. For this purpose, the pedal 21 may be attached to a gear formed inside the main body 11. Whenever the pedal moves, the gear may be rotated to rotate a gear attached to the central shaft 22. However, when the user steps on the left pedal 21, the central shaft 22 may rotate to the left, and when the user steps on the right pedal 21, the central shaft 22 may rotate to the right. Thus, whenever the user steps on the pedal, the central shaft 22 may rotate little by little in the direction of the pedal. A rotational angle may be adjusted, but may return back to an original position when the rotation is over.

In addition, even when the rotation is not made particularly by pedaling, the rotation may be performed in such a way that force is naturally applied in a direction that the user steps on the pedal, if the main body 11 is rotatably attached to the floor portion 14. Even when riding a bicycle in reality, the user may maintain a balance by turning a handlebar against the force applied by stepping on the pedal. However, in the conventional indoor cycle, the handlebar and the pedal do not move in linkage with each other, thereby giving no actual feel of moving. However, just if the main body 11 is allowed to turn around the floor portion 14, the main body 11 may turn little by little in a direction that the user steps on the pedal, so that the user may get a feel similar to reality.

In addition, any one of the main body 11, the central shaft 22 and a rotary plate 25 may further include a repositioning device formed of an elastic material. Thus, the main body 11 may return, when force is not applied in one direction. And, other devices having elasticity may be also used.

The repositioning device may be made of an elastic material such as a spring or a rubber band, and may include a repositioning device having a known type above. If the spring is provided on both sides of the rotating central shaft 22 and a rotation is made in any one direction, the central shaft 22 may be returned to an original position by the spring.

When actually riding a bicycle, the user who rides the bicycle may maintain a balance by receiving a repulsive force against the ground and slightly shifting the user's weight to finely adjust a handlebar. However, if there is no spring, rotation may be continuously made in one direction. Thus, the spring may be provided to restore to an original state, so that the user can feel as if the user rides the bicycle in reality.

In addition, in case of making a gradual rotation in a direction that the user steps on the pedal and restoring to the original state, it is possible to reduce a load applied to knees when the knees are stretched in the direction that the user steps on the pedal and the knees are stretched when restoring to the original state.

For smooth rotation, the central shaft 22 may be coupled to a bearing 24 coupled to a rotary plate 23 inside the floor portion 14, and the rotary plate 23 may be coupled to the floor portion 14 inside the floor portion 14.

In order to easily store the indoor cycle at home, a plurality of wheels 25 may be laterally coupled to sides of the floor portion 14, and a first floor arm 17 and a second floor arm 18 may have a section of "□" shape and the wheel 25 may move along a rail inside the first floor arm 17 and the second floor arm 18. In other words, the floor portion 14 may move along the rail inside the first floor arm 17 and the second floor arm 18 together with the main body 11. A second rotating shaft 26 may be formed at an outer end of the first floor arm 17, and the first floor arm 17 and the second floor arm 18 may be also rotatably coupled to the second rotating shaft 26. When the cycle according to the present invention is to be folded, the main body 11 may be strongly pushed toward (forward) the second floor arm 18, after which the first floor arm 17 may be folded up. Then, a floor area occupied by the cycle may occupy only an area as much as the floor portion 14 as shown in the drawing, thereby facilitating storage.

The first floor arm 17 and the second floor arm 18 may be divided into a rail portion 31 through which the wheel 25 may pass and a rail support portion 32 formed with the second rotating shaft 26 for rotation. And the rail portion 31 may be attached to the rail support portion 32.

In addition, in order to prevent the first floor arm 17 and the second floor arm 18 from colliding with each other when rotating near the second rotating shaft 26, only one of the rail support portions 32 may protrude such that end portions of the rail support portions 32 can be offset from each other.

A handle portion 19 located at a front of the cycle machine may be connected to the second floor arm 18, so that the user holds the handle portion 19 when doing exercise and a monitor or a mobile phone may be mounted on a lower end of the handle portion 19.

The conventional indoor cycle machine needs to secure a certain floor area in order to properly keep a balance when the user does exercise. Thus, in many cases, it has been burdensome to store the equipment that occupies a certain area or more at home. As shown in the drawing, however, when the equipment according to the present invention is folded, a floor area occupied thereby may be about half a floor area when unfolded, and thus the equipment may not be burdensome to use.

A control unit may be formed in the main body 11, and if the control unit 29 is placed at the handle portion 19, a wire may need to be connected to the inside, thereby causing a rise in unit price and failure, and making it difficult to perform operations such as folding. In the present invention, the control unit 29 for settings may be placed at a part of an upper surface of the main body 11 to perform settings. Since the control unit is formed at the main body 11, there may be no need to connect an electric wire to the outside of the main body 11.

The rotary plate 23 may rotate with the central shaft 22 while rotating with the main body 11. If the main body 11 is supported only by the central shaft 22, there is a risk that the main body 11 may incline to any side. In the present invention, a rotation support ball 27 fixed to the floor portion 14 may be formed under the rotary plate 23. The rotation support ball 27 may support the rotary plate 23 while a ball or wheel comes into contact with a lower surface of the rotary plate 23. However, the rotation support ball 27 may also easily rotate when the rotary plate 23 rotates.

In addition, a pin hole may be formed in an upper surface of the rail support portion 32, and a pin hole corresponding to the pin hole formed on the upper surface of the rail support portion 32 may be also formed on an upper surface of the floor portion 14. Thus, a pin 28 may be used for fixation when the floor portion 14 moves along the rail and comes to a position desired by the user. For fixation, other fixing devices such as screws may be also used.

Figure 10:
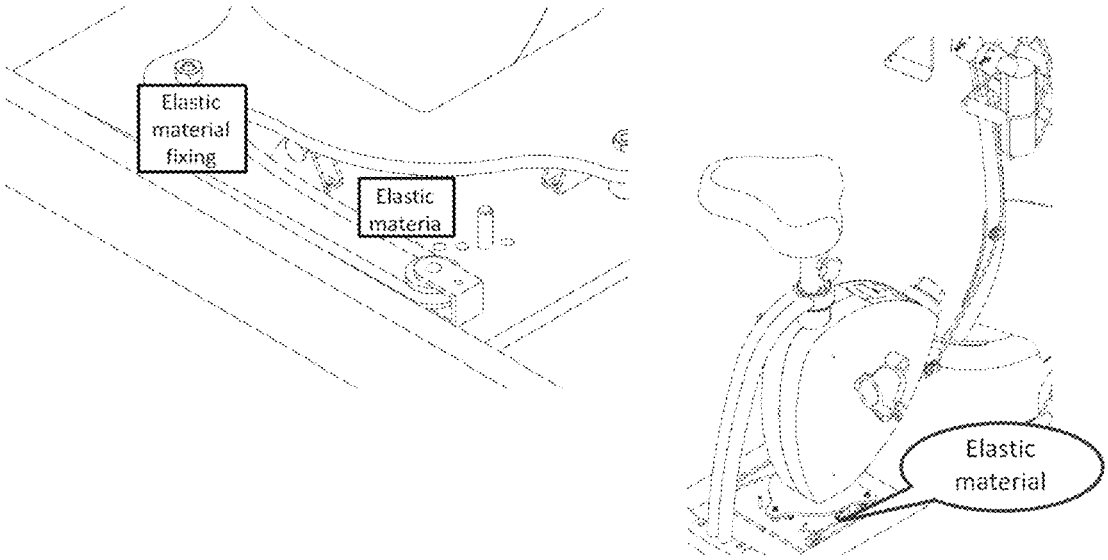

FIG. 10 shows an example in which an elastic material such as a long rubber band is used as a repositioning device. The elastic material may have one end fixed to a lower end of the rotary plate, and have an opposite end passed through a roller and fixed to a bottom plate. The roller may not be essential and the spring and the like may be used instead of the rubber band. In FIG. 10, the repositioning device may be installed at both sides of the rotary plate.

Figure 11:
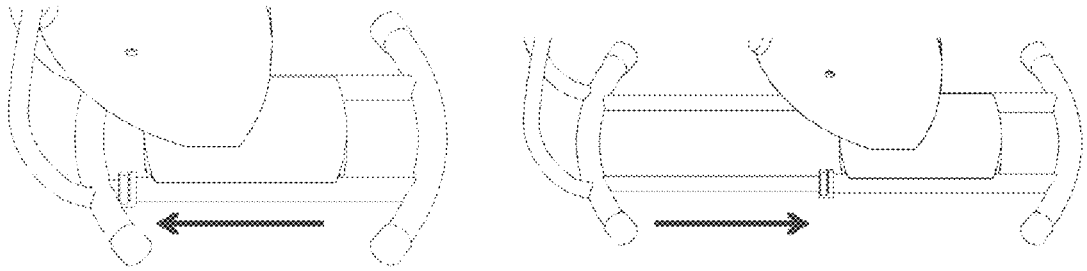

FIG. 11 shows another embodiment of the first floor arm and the second floor arm. In FIG. 11, the second floor arm may be inserted into the first floor arm, and the floor portion may be coupled to the first floor arm, and some components may be omitted.

Figure 12:
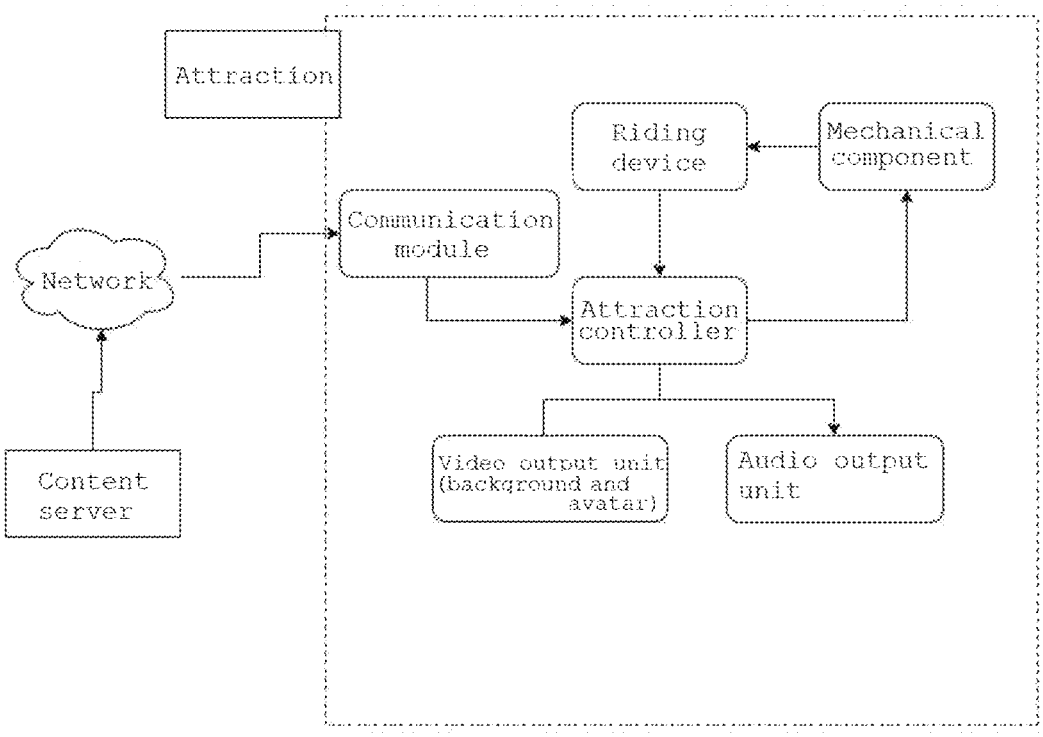

FIG. 12 shows an example of using attraction. The device in FIG. 1 may correspond to a riding device and may be operated in such a way that an attraction controller actuates a mechanical component. The riding device may receive an input signal, and thus the attraction controller may output a video and an audio through a video output unit and an audio output unit, and the video and the audio may be subject to change depending on the input signal from the riding device. In addition, content may be inputted from a content server through a network and used to output the video and the audio.

What is claimed is:

1. An indoor cycle machine providing a user with virtual experience and exercise without straining knees, the indoor cycle machine comprising:

a main body rotatably coupled onto a floor portion;

a vertical support having one end coupled to the floor portion and an opposite end formed with a vertical through-hole; and a saddle support having one end coupled to an upper end of the main body and an opposite end formed with a saddle, in which the saddle support passes through the vertical through-hole such that the saddle support is rotatable inside the vertical through-hole, wherein the main body is rotated on the floor portion whenever the user steps on a pedal formed on the main body.

2. The indoor cycle machine of claim 1, wherein a central shaft extends in a vertical direction of the main body, and the saddle support is coupled upward of the central shaft, so that the main body moves and rotates according to rotation of the central shaft.

3. The indoor cycle machine of claim 2, wherein the main body includes a repositioning device formed of an elastic material, so that the main body rotates in one direction and returns back to an original position.

4. The indoor cycle machine of claim 3, wherein:

wheels are formed at both sides of the floor portion, each wheel moves by rolling in an inner part of a rail portion of a first floor arm and a second floor arm having a section of "⊂" shape, and a rail support portion is formed at an outer side of the rail portion to support the rail portion.

5. The indoor cycle machine of claim 4, wherein the rail support portion of each of the first floor arm and the second floor arm is rotatably coupled to a second rotating shaft.

6. The indoor cycle machine of claim 5, wherein a control unit is formed at the main body for settings required for exercise.

7. The indoor cycle machine of claim 6, wherein:

a pin hole for pin coupling is formed at an upper surface of the rail support portion, so that a pin is inserted and coupled into both a pin hole formed in the floor portion, and the pin hole formed in the upper surface of the rail support portion when an upper surface of the floor portion covers the upper surface of the rail support portion.

8. The indoor cycle machine of claim 5, wherein:

a rotary plate having a round plate shape is attached to a lower end of the central shaft, the central shaft rotates along a bearing attached to the floor portion, and a plurality of rotation support balls are formed under the rotary plate and on a bottom surface of the floor portion to support the rotary plate while allowing the rotary plate to smoothly rotate.

9. The indoor cycle machine of claim 3, wherein a first floor arm is coupled to both sides of the floor portion and a second floor arm is received into a space inside the first floor arm, so as to reduce a space occupied by the indoor cycle machine on a floor surface when folded.

10. The indoor cycle machine of claim 2, wherein first floor arm is coupled to both sides of the floor portion and second floor arm is received into a space inside the first floor arm, so as to reduce a space occupied by the indoor cycle machine on a floor surface when folded.

11. The indoor cycle machine of claim 1, wherein a first floor arm is coupled to both sides of the floor portion and a second floor arm is received into a space inside the first floor arm, so as to reduce a space occupied by the indoor cycle machine on a floor surface when folded.

* * * * *